US007194093B1

(12) United States Patent
Thiede

(10) Patent No.: US 7,194,093 B1
(45) Date of Patent: Mar. 20, 2007

(54) MEASUREMENT METHOD FOR PERCEPTUALLY ADAPTED QUALITY EVALUATION OF AUDIO SIGNALS

(75) Inventor: Thilo Thiede, Gentofte (DK)

(73) Assignee: Deutsche Telekom AG, Bonn (DE)

( * ) Notice: Subject to any disclaimer, the term of this patent is extended or adjusted under 35 U.S.C. 154(b) by 0 days.

(21) Appl. No.: 09/311,490

(22) Filed: May 13, 1999

(30) Foreign Application Priority Data

May 13, 1998 (DE) ..... 198 21 273

(51) Int. Cl.
*H04R 29/00* (2006.01)

(52) U.S. Cl. ..... 381/58; 381/56

(58) Field of Classification Search ..... 341/50; 704/500, 225, 200.1, 200; 381/59, 58, 94.1, 381/94.2, 94.3, 94.7
See application file for complete search history.

(56) References Cited

U.S. PATENT DOCUMENTS 4,450,531 A * 5/1984 Kenyon et al. ..... 708/5
5,210,820 A * 5/1993 Kenyon ..... 704/200

(Continued)

FOREIGN PATENT DOCUMENTS

DE 195 23 327 1/1997

OTHER PUBLICATIONS

Karlheinz Brandenburg et al., *"NMR" and "Masking Flag": Evaluation of Quality Using Perceptual Criteria,* AES 11th International Conference, May 1992, pp. 169-178.

(Continued)

*Primary Examiner*—Sinh Tran
*Assistant Examiner*—Andrew C Flanders
(74) *Attorney, Agent, or Firm*—Kenyon & Kenyon LLP

(57) ABSTRACT

A measurement method for evaluating the disturbances in an audio signal or test signal (1*a, b*) by comparing it to an undisturbed reference signal (1*c, d*). After being prefiltered (2) using the transfer functions of the outer and middle ear, the input signals are converted to a time-pitch representation by an perceptually adapted filter bank (3). Squares of absolute values (5) of the filter output signals are calculated (rectified), and the filter outputs are convoluted with a spreading function (4). Convolution can take place either before or after rectification. Level differences between the test and reference signals as well as linear distortions of the reference signals are compensated for in step (7) and evaluated separately. In step (8), a frequency-dependent offset is then added in order to model the residual noise of the ear, and the output signals are spread over time (9). Part of this time spreading operation can take place directly after rectification in step (4) in order to reduce computing time. After the time spreading step (8) (low-pass filtration), subsampling of the signals may then be performed. By comparing the resulting aurally compensated time-frequency patterns of the test and reference signals (1*a, b* and 1*c, d*), it is possible to calculate a series of output quantities in step (10), which provide an estimate of the discernible disturbances.

23 Claims, 2 Drawing Sheets

U.S. PATENT DOCUMENTS

| | | | | |
|---|---|---|---|---|
| 5,724,006 | A * | 3/1998 | Kilian et al. | 330/294 |
| 5,926,553 | A * | 7/1999 | Keyhl et al. | 381/2 |
| 6,271,771 | B1 * | 8/2001 | Seitzer et al. | 341/50 |

OTHER PUBLICATIONS

M. R. Schroeder et al., "Optimizing digital speech coders by exploiting masking properties of the human ear", J. Acoust. Soc. Am. 66(6), Dec. 1979, pp. 1647-1652.

John G. Beerends et al., "A Perceptual Audio Quality Measure Based on a Psychoacoustic Sound Representation", J. Audio Eng. Soc., vol. 40, No. 12, Dec. 1992, pp. 963-978.

K.J. Ray Liu, "Novel Parallel Architectures for Short-Time Fourier Transform," IEEE Transactions on Circuits and Systems—II: Analog and Digital Signal Processing, vol. 40, No. 12, Dec. 1993.

* cited by examiner

MEASUREMENT METHOD FOR PERCEPTUALLY ADAPTED QUALITY EVALUATION OF AUDIO SIGNALS

FIELD OF THE INVENTION

The present invention relates to a measurement method for perceptually adapted quality evaluation of audio signals.

BACKGROUND INFORMATION

Measurement methods for perceptually adapted quality assessment of audio signals are generally known. The basic structure of a measurement method of this type includes mapping the input signals onto an perceptually adapted time-frequency representation, comparing this representation, and calculating individual numeric values in order to estimate the discernible disturbances. Reference is made in this regard to the following publications:

Schroeder, M. R.; Atal, B. S.; Hall, J. L: Optimizing Digital Speech Coders by Exploiting Masking Properties of the Human Ear. J. Acoust. Soc. Am., Vol. 66 (1979), No. 6, December, pages 1647–1652;

Beerends, J. G.; Stemerdink, J. A.: A Perceptual Audio Quality Measure Based on a Psychoacoustic Sound Representation. J. AES, Vol. 40 (1992), No. 12, December, pages 963–978; and Brandenburg, K. H.; Sporer, Th.: NMR and Masking Flag: Evaluation of Quality Using Perceptual Criteria. Proceedings of the AES 11$^{th}$ International Conference, Portland, Oreg., USA, 1992, pages 169–179, all three of which are hereby incorporated by reference herein.

As described in these publications, however, the models used for assessing coded audio signals employ FFT (fast Fourier transform) algorithms and thus require the linear frequency division predetermined by the FFT to be converted to an perceptually adapted frequency division. This makes the time resolution less than optimal. In addition, convolution with a spreading function is carried out after rectification or absolute-value generation, reducing the spectral resolution without increasing the temporal resolution correspondingly.

Additionally, fast filter bank algorithms which, for example, can be used for calculating short time Fourier transforms in, for example, very large scale integrated (VLSI) circuits, are known. See Liu, K. J. R.: Novel Parallel Architectures for Short-Time Fourier Transform. IEEE Trans. on Cir. and Sys.-II: Anal. and Dig. Sig. Proc., Vol. 40, No. 12, December 1993, pages 786–790.

SUMMARY OF THE INVENTION

An object of the present invention is therefore to provide an objective measurement method for the perceptually adapted quality evaluation of audio signals using new, fast algorithms for calculating linear-phase filters. The impact of the audible disturbances can be calculated, taking into account the variation over time of the envelopes at the individual filter outputs, using an aurally adjusted filter bank. Thus, an optimum time resolution can be achieved and, in fact, with a significant reduction in the computing time compared to other filter banks.

The present invention provides a measurement method for perceptually adapted quality evaluation of audio signals using filters, time spreading, and level and frequency response adjustment, characterized in that:

the audio signal to be evaluated is compared, in the form of a test signal (1*a, b*), to a source signal supplied in the form of a reference signal (1*c, d*);

the two signals, or signal pairs (1*a, b*; 1*c, d*), after a prefiltration (2), are split into the frequency domain by a filter bank (3);

the characteristic of the filter bank (3) and subsequent time spreading (9) of the filter output signals yield an perceptually adapted representation of audio signals to be evaluated in the form of a test signal (1*a, b*); and a comparison of the aurally compensated representations of the test signal (1*a, b*) and reference signal (1*c, d*) following non-linear transformations provides an estimate of the auditory impression to be expected.

The present method advantageously may further include that: (a) the filter bank (3) is aurally adjusted, and an undamped sinusoidal oscillation having the desired filter mid-frequency is generated from each incoming signal by recursive, complex multiplication; and the sinusoidal oscillation belonging to a test signal (1*a, b*) is discontinued again by subtracting the input test signal (1*a, b*) delayed by an amount of time equal to the reciprocal value of the desired filter bandwidth and multiplied by the phase angle corresponding to the delay; (b) by convolution within the frequency range, an attenuation characteristic corresponding to the Fourier transform of a $\cos^n$ (n−1)-wave time window is produced from n filter outputs having the same bandwidth and the mid-frequency, offset by the reciprocal value of the window length; (c) the attenuation characteristic at a greater distance from the filter mid-frequency at the transition between the pass band and stop band is determined by a further convolution within the frequency range; (d) the input test signals (1*a, b*) and the reference signals (1*c, d*) are inputted in the form of input quantities for a left and a right channel, i.e. in pairs; and/or (e) the test signals (1*a, b*) and the reference signals (1*c, d*) first undergo prefiltration (2) and are then supplied to a filter bank (3); a spectral spreading step (4) takes place next; squares of absolute values (5) are calculated, after which a time spreading step is carried out; the output quantities obtained in this manner undergo a level and frequency response adjustment (7); and an offset, taking into account residual noise (8) is then added, after which another time spreading step (9) and a calculation (10) of output parameters (11) are carried out, or step (7) is performed between steps (9) and (10).

The method of the present invention advantageously also may include that the input signals, after being filtered with the transmission functions of the outer and middle ear using input signals, are converted to a time-pitch representation by an perceptually adapted filter bank (3), squares of absolute values (5) of the filter output signals are then calculated, and the filter output signals are convoluted with a spreading function (6); (g) convolution takes place before or after rectification. Furthermore, level differences between the test and reference signals (1*a, b* and 1*c, d*) as well as linear distortions of the reference signal (1*c, d*) may be compensated for and evaluated separately. Part of the time spreading operation may take place directly after rectification and an perceptually adapted filter bank may be used which produces a signal dependency of the filter characteristics by convoluting the filter outputs prior to rectification/absolute-value generation within the frequency domain using a level-dependent spreading function. In addition, signal components already existing in the reference signal (1*c, d*) which vary only in terms of their spectral distribution may be separated from additive disturbances or those produced by non-linearities; and these disturbance components are separated by evaluating the orthogonality relation between the temporal envelopes of corresponding filter outputs of the test signal (1*a, b*) to be evaluated and the reference signal (1*c, d*); (1) the filter bank (3) may include a arbitrarily selected number of filter pairs for test and reference signals (1*a, b* and 1*c, d*); and the distribution of the center frequency and bandwidths of the filters may be chosen in accordance with any known auditory frequency scale. any sound level scales. The output values of the filter bank (3) can be smeared out over adjacent filter banks in order to take into account simultaneous masking at the upper edge; the level used to determine the slope of the spreading function can be calculated respectively for each filter output from the squares of absolute value (5), which was low-pass-filtered with a time constant, of the corresponding output value, or determined without a low-pass filter, with the spreading factor being low-pass-filtered instead; and spreading may be carried out independently for the filters representing the real portion of the signal and the filters representing the imaginary portion of the signal. Moreover, the filter output signals may be spread over time in two stages, with the signals being determined via a cosine$^2$-wave time window during the first stage and post-masking being modeled during the second stage. The present method furthermore may include that: (a) the cosine$^2$-wave time windows are between 1 and 16 ms long; (b) to adjust the level the instantaneous squares of absolute values (5) are smoothed over time at the filter outputs by first-order low-pass filters; the time constants used are selected as a function of the mid-frequency of the corresponding filter; and a correction factor is calculated from the orthogonality relation between spectral envelopes of the time-smoothed filter outputs of the test and reference signals (1*a, b* and 1*c, d*); (c) the test signal is multiplied by the correction factor if the correction factor is less than 1, and the reference signal is divided by the correction factor if the correction factor is greater than 1; (d) to compensated for linear distortions correction factors are calculated for each filter channel from the orthogonality relation between the time envelopes of the filter outputs of the test and reference signals (1*a, b* and 1*c, d*); (e) a modulation difference, which is suitable for estimating certain audible disturbances, is determined for each filter channel and each filter band from the (absolute) difference, normalized to the modulation of the reference signal, of the envelopes of the test and reference signals following time and spectral averaging; (f) the partial loudness of the disturbance is determined from input values in the form of the squared values (5) in each filter channel, the envelope modulation, the residual noise of the ear, and constants and then averaged over time and filter channels; and/or (g) the input signal (X) is delayed by N sampled values and, after being multiplied by a complex-number factor, it is subtracted from the original input signal; the resulting signal (V) is added to the output signal that was delayed by one sampled value; and the result, multiplied by a further complex-number factor, yields the new output signal.

One important advantage of the method according to the present invention is that it provides a more precise auditory model, since audible disturbances are calculated, taking into account the variation over time of envelopes at the individual filter outputs.

Furthermore, an perceptually adapted filter bank is used, achieving an optimum time resolution, and the behavior of the filters over time (impulse response, etc.) corresponds directly to the level dependence of the transmission functions. The phase information in the filter channels is retained. As mentioned above in the Background Information section, convolution with a spreading function takes place only after rectification or absolute-value generation in previously known methods. A signal dependency of the filter characteristics is produced by convoluting the filter outputs prior to rectification/absolute-value generation within the frequency range using a level-dependent spreading function.

The use of a new fast algorithm for the recursive calculation of linear-phase filters results in a much shorter computing time, a simpler design, and filter that can be varied more easily than conventional recursive filters.

Signal components already existing in the source signal which vary only in terms of their spectral distribution are separated from additive disturbances or those produced by non-linearities, with the signal components being separated by evaluating the orthogonality relation between the variations over time of the envelopes at corresponding filter outputs of the signal to be evaluated and the source signal. The separation of these interference components corresponds more efficiently to the actual auditory impression.

The filter bank algorithm may be formulated as follows:

An undamped sinusoidal oscillation having the desired filter mid-frequency is generated from each incoming pulse by recursive, complex multiplication.

The sinusoidal oscillation belonging to an input pulse is discontinued again by subtracting the input pulse delayed by an amount of time equal to the reciprocal value of the desired filter bandwidth and multiplied by the phase angle corresponding to the delay.

By convolution within the frequency range, an attenuation characteristic corresponding to the Fourier transform of a $\cos^n(n-1)$-wave time window is produced through the weighted summation of n filter outputs having the same bandwidth and the mid-frequency, offset by one period, of the sin(x)/x-wave attenuation characteristic resulting from step 2. This enables the attenuation characteristic to be formed within the region of the filter mid-frequencies, providing an adequately high stop-band attenuation.

The attenuation characteristic at a greater distance from the filter mid-frequency can be determined by further convolution within the frequency range (transition between the pass band and the stop band).

BRIEF DESCRIPTION OF THE DRAWINGS

Further advantages, features, and applications of the present invention are derived from the following description in conjunction with the embodiments illustrated in the drawings. The present invention is described in greater detail below on the basis of the embodiments illustrated in the drawings, in which.

DETAILED DESCRIPTION

The present measurement method evaluates the disturbances in an audio signal by comparing it to an undisturbed reference signal. After being filtered using the transfer functions of the outer and middle ear, the input signals are converted to a time-pitch representation by an perceptually adapted filter bank. The squares of absolute values of the filter output signals are calculated (rectified), and the filter outputs are convoluted by a spreading function. Unlike the previously known methods, convolution can take place not only after, but also before, rectification. Level differences between the test and reference signals as well as linear distortions in the test signal are compensated for and evaluated separately. A frequency-dependent offset is then added in order to model the residual noise of the ear, and the output signals are spread over time. Part of this time spreading operation can take place directly after rectification in order to reduce computing time. After time spreading (low-pass filtration), subsampling of the signals may then be performed. By comparing the resulting perceptually adapted time-frequency patterns of the test and reference signals, it is possible to calculate a series of output quantities which provide an estimate of the discernible disturbances.

Figure 1:
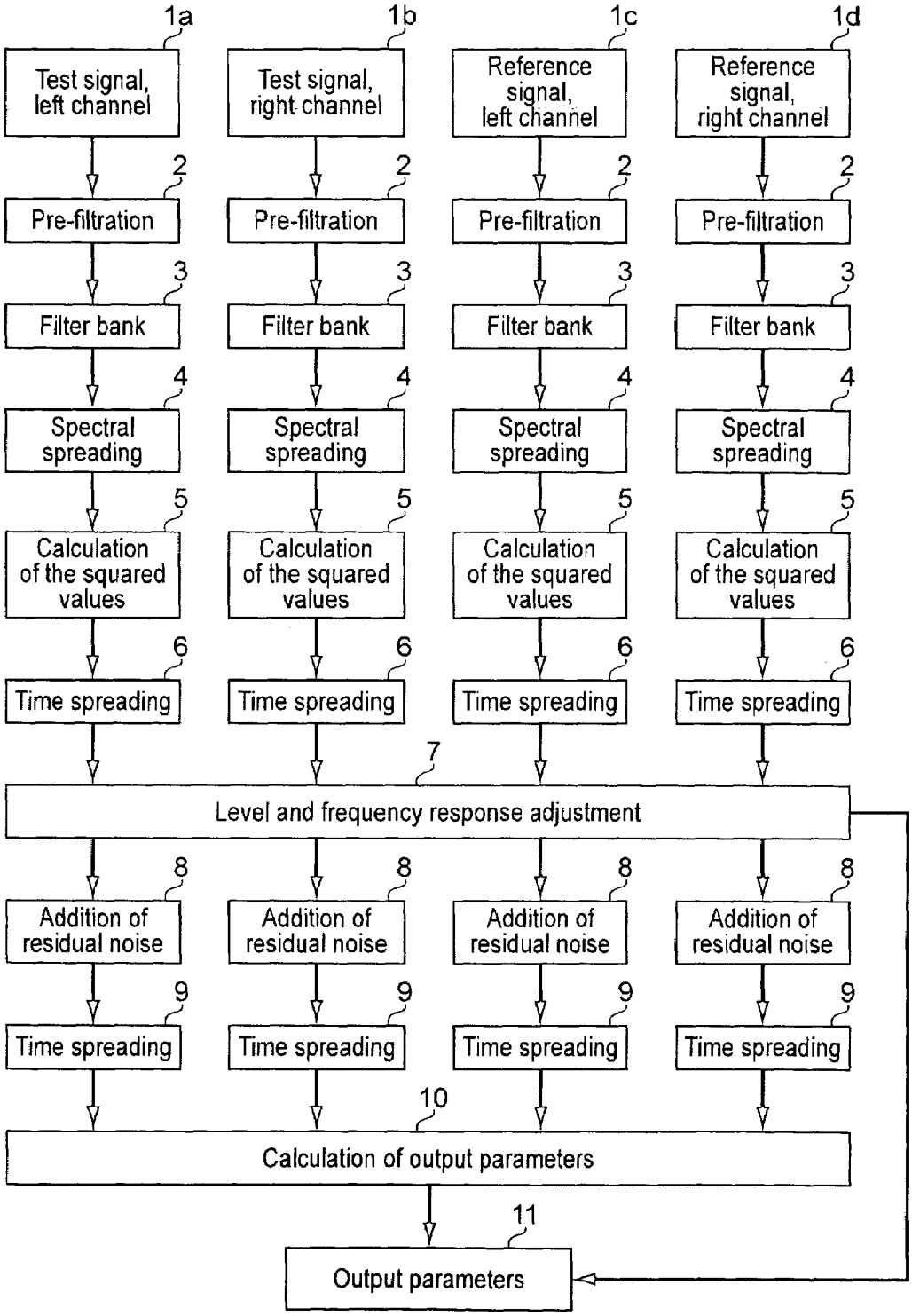
FIG. 1 shows a structure of the measurement method.

First of all, an explanation of the structure or layout of the measurement method illustrated as an embodiment in FIG. 1 is given. Test signals 1*a*, 1*b* for the left and right channels and reference signals 1*c* and 1*d* for the left and right channels are supplied to prefilters 2 for prefiltration. Prefiltration is followed by actual filtration in filter bank 3. Spectral spreading 4 and the calculation of the squares of absolute values 5 take place next. The boxes labeled 6 in the figure symbolize the time spreading step. Level and frequency response adjustment 7 is carried out next, with output parameters 11 also being supplied. Level and frequency adjustment 7 is followed by the addition of residual noise 8, followed by time spreading 9. In the structure illustrated, output parameters 11 are calculated in symbolically represented block 10. Level and frequency response adjustment 7 can also take place between steps or operations 9 and 10.

The calculation of the excitation patterns using aurally adjusted filter bank 3 is described first.

Filter bank 3 includes a arbitrarily selected number of filter pairs for test and reference signals 1*a,b* and 1*d,c* (values between 30 and 200 are reasonable). The filters can be evenly distributed according to practically any pitch scales. A suitable sound level scale, for example, is the following approximation proposed by Schroeder:

$$z/Bark = 7 \cdot arsinh\left(\frac{f/\mathrm{Hz}}{650}\right) \qquad \text{Eq. 1}$$

The filters are linear-phase filters and are defined by impulse responses as follows:

$$h_{re}(t) = \cos^n(\pi \cdot bw \cdot t) \cdot \cos(2\pi \cdot f_c \cdot t), \quad |t| < \frac{1}{2 \cdot bw} \qquad \text{Eq. 2}$$

and $$h_{im}(t) = \cos^n(\pi \cdot bw \cdot t) \cdot \sin(2\pi \cdot f_c \cdot t), \quad |t| < \frac{1}{2 \cdot bw} \qquad \text{Eq. 3}$$

The value n determines the filter stop-band attenuation and should be ≧2.

To take into account simultaneous masking, the output values of filter bank 3 are spectrally spread upon reaching 31 dB/Bark at the lower edge and between −24 and −6 dB/Bark at the upper edge, which means that crosstalk is produced between the filter outputs. The upper edge is calculated depending on the level:

$$s = \min\left(-6\frac{\mathrm{dB}}{Bark}, -24\frac{\mathrm{dB}}{Bark} + 0.2\ Bark^{-1} \cdot L/\mathrm{dB}\right) \qquad \text{Eq. 4}$$

Level L is calculated independently for each filter output from square of absolute value 5, which was low-pass-filtered with a time constant of 10 ms, of the corresponding output value. This spreading step is carried out independently for the filters representing the real portion of the signal (Equation 2) and the filters representing the imaginary portion of the signal (Equation 3). Alternatively, the level can also be calculated without a low-pass filter, with the crosstalk-determining factor produced by delogarithmization of edge steepness (Equation 4) being low-pass-filtered instead. Because this convolution operation is more or less linear, thus maintaining the relation between the resulting frequency response and the resulting impulse response, it can be viewed as part of filter bank 3.

Because filter bank 3 supplies pairs of output signals that are out of phase by 90°, rectification can be carried out by generating squared values 5 of the filter outputs:

$$E(f_c,t) = A_{re}^2(f_c,t) + A_{im}^2(f_c,t) \qquad \text{Eq. 5}$$

The filter output signals are spread over time in two stages. During the first stage, the signals are averaged via a $\cos^2$-wave time window, which primarily models pre-masking. During the second stage, post-masking is modeled, which will be described in greater detail later on. The $\cos^2$-shaped time window has a length of 400 samples at a sampling rate of 48 kHz. The interval between the time window maximum and its 3 dB point is thus around 100 sampled values, or 2 ms, which corresponds approximately to a time period frequently assumed for pre-masking.

Level differences and linear distortions (frequency responses of the test object) between test and reference signals 1*a,b* and 1*c,d* can be compensated for and thus separated from the evaluation of other types of disturbances.

To adjust the level, the instantaneous squares of absolute values are smoothed over time at the filter outputs by first-order low-pass filters. The time constants used are selected as a function of the mid-frequency of the corresponding filter:

$$\tau = \tau_0 + \frac{100\ \mathrm{Hz}}{f_c} \cdot (\tau_{100} - \tau_0); \quad \begin{matrix} \tau_{100} = & 0.004 - ls \\ \tau_0 = & 0.004 - ls \end{matrix}, \qquad \text{Eq. 6A}$$

where $\tau_{100} \geq \tau_0$.

correction factor $corr_{total}$ is calculated from filter output values $P_{test}$ and $P_{ref}$ smoothed in the following manner:

$$corr_{total} = \left(\frac{\sum \sqrt{P_{Test} \cdot P_{Ref}}}{\sum P_{Test}}\right)^2 \qquad \text{Eq. 7}$$

If this correction factor is greater than one, reference signal 1*a,b* is divided by the correction factor; otherwise, test signal 1*c,d* is multiplied by the correction factor.

Additional correction factors are calculated for each filter channel from the orthogonality relation between the temporal envelopes of the filter outputs of test and reference signals 1$a,b$ and 1$c,d$:

$$ratio_{f,t} = \frac{\int_{-\infty}^{0} e^{\frac{t}{\tau}} \cdot X_{Test} \cdot X_{Ref}\, dt}{\int_{-\infty}^{0} e^{\frac{t}{\tau}} \cdot X_{Ref} \cdot X_{Ref}\, dt} \quad \text{Eq. 8}$$

The time constants are determined according to Equation 6. If $ratio_{f,t}$ is greater than one, the correction factor for the test signal is set to $ratio_{f,t}^{-1}$, and the correction factor for the reference signal is set to one. In the opposite situation, the correction factor for the reference signal is set to $ratio_{f,P}$ and the correction factor for the test signal is set to one.

As mentioned above, the correction factors are smoothed over time across multiple adjacent filter channels, using the same time constants, as above.

A frequency-dependent offset for modeling the residual noise of the ear is added to the squares of absolute values at all filter outputs. A further offset can also be added to take into account background noises (but is usually set to 0).

$$E(f_c, t) = E(f, t) + 10^{0.364\cdot\left(\frac{f_c}{\text{kHz}}\right)^{-0.8}} \quad \text{Eq. 9}$$

To model post-masking, the instantaneous squares of absolute values in each filter channel are spread over fixed time by a first-order low-pass filter, using a time constant of around 10 ms. Alternatively, the time constant can also be calculated as a function of the mid-frequency of the corresponding filter. In this case, it is around 50 ms for low frequencies and around 8 ms for high frequencies (like in Equation 6).

Before carrying out the second stage of time spreading just described, a simple approximation of loudness is calculated by raising the squares of absolute values at the filter outputs to the power of 0.3. This value $\overline{E}$ and the absolute value of its time derivation $d\overline{E}/dt$ are smoothed with the same time constants as described above. A measure for the envelope modulation in each channel is determined from the result of time smoothing operation $\overline{E}_{der}$:

$$\text{mod}(f_c, t) = \frac{\overline{E}_{der}(f_c, t)}{1 + \overline{E}(f_c, t)} \quad \text{Eq. 10}$$

The most important output parameter of the method, and the one that correlates the most closely to subjective hearing test data, is the loudness of the disturbance in the presence of reduction by the useful signal. The input values here are squares of absolute values in each filter channel $E_{ref}$ and $E_{test}$ ("excitation"("at threshold")), the envelope modulation, the residual noise of the ear ("excitation")$E_{HS}$, and constants $E_0$ and $\alpha$. The reduced loudness of the disturbance is calculated as follows:

$$NL(f_c, t) = \left(\frac{1}{S_{test}} \cdot \frac{E_{HS}}{E_0}\right)^{0.23} \cdot \left[\left(1 + \frac{\max(S_{test} \cdot E_{test} - S_{ref} \cdot E_{ref}, 0)}{E_{HS} + S_{ref} \cdot E_{ref} \cdot \beta}\right)^{0.23} - 1\right] \quad \text{Eq. 11}$$

where:

$$E_{HS} = 10^{0.364\cdot\left(\frac{f_c}{\text{kHz}}\right)^{-0.8}}$$

$$E_0 = 10^4$$

$$\alpha = 1.0$$

$$s = 0.04 \times \text{mod}(f_c, t)/\text{Hz} + 1$$

Equation 11 is formulated in this case so that it supplies the specific loudness of the disturbance when no masker is present as well as the approximate ratio between the disturbance and masker when the disturbance is very small, compared to the masker. Factor β determining the loudness reduction is calculated according to the following equation:

$$\beta = \exp\left(-\alpha \cdot \frac{E_{Test} - E_{ref}}{E_{ref}}\right) \quad \text{Eq. 12}$$

The reduced loudness of the disturbance matches the average of this quantity over time and filter channels. To identify linear distortions, the same calculation is carried out once again without the frequency response adjustment, with the test and reference signals being reversed in the equations shown above. The resulting output parameter is referred to the "loudness of missing signal components". With the help of these two output quantities, it is possible to accurately predict the subjectively perceived signal quality of a coded audio signal. Alternatively, linear distortions can also be identified by using the reference signal prior to the signal adjustment as the test signal. A further output quantity is the modulation difference defined as the absolute value of the difference between the test and reference signal modulations normalized to the reference signal modulation. When normalizing this value to the reference signal, an offset is added in order to limit the calculated values if the reference signal modulation is very small:

$$\text{Modulation difference} = \frac{\text{mod}test - \text{mod}ref}{Offset + \text{mod}ref}$$

The modulation difference is averaged over time and filter bands.

The modulation used on the input side is produced by normalizing the time derivation of the instantaneous values to values that have been smoothed over time.

Figure 2:
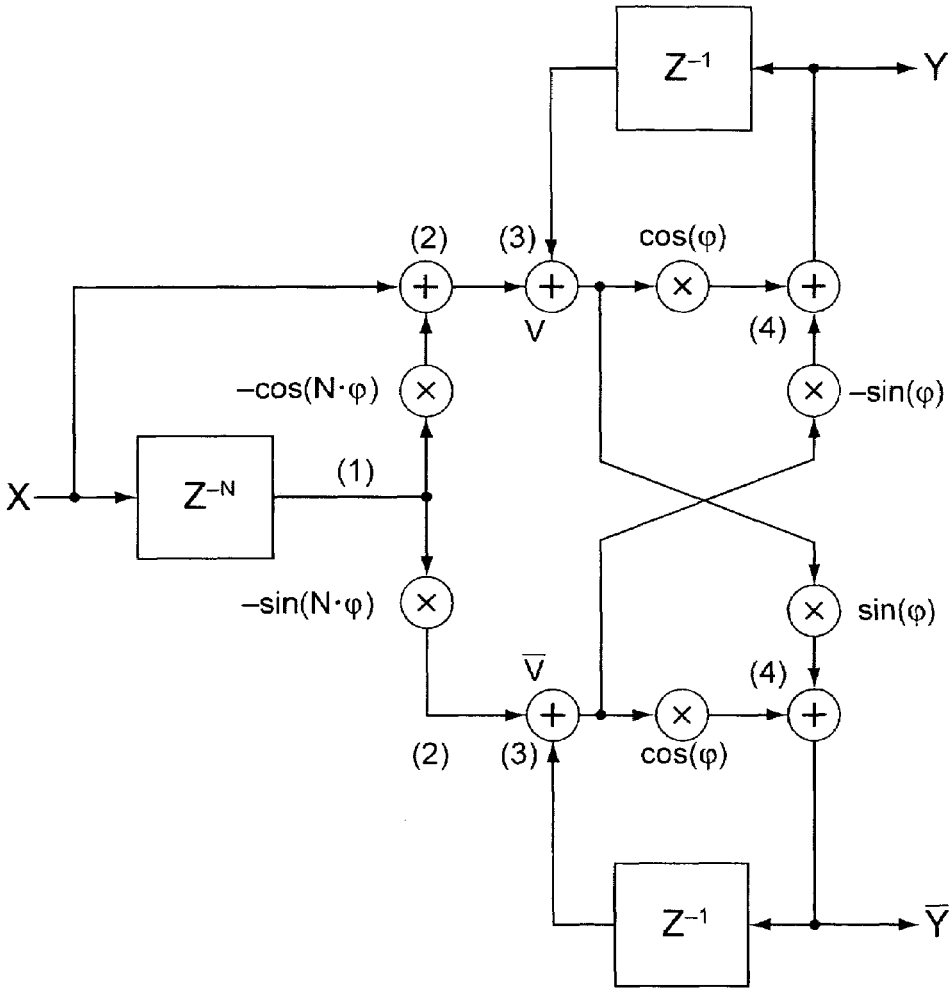
FIG. 2 shows a filter structure.

FIG. 2 shows a filter structure for the recursive calculation of a simple band-pass filter with a finite impulse response (FIR).

The signal is processed separately according to its real portion (upper path) and imaginary portion (lower path): Because input signal X originally has only a real portion, the lower path does not initially exist. Input signal X is delayed by N sampled values (1) and, after being multiplied by a complex-number factor cos(N×ϕ)+j×sin(N×ϕ), it is subtracted from the original input signal (2). Resulting signal V is added to the output signal that was delayed by one sampled value (3). The result, multiplied by a further complex-number factor cos(ϕ)+j×sin(ϕ), yields new output signal Y (4). The overscored designators for V and Y each mark the imaginary portion.

The second complex multiplication operation propagates the input signal periodically. The input signal propagation is then discontinued after N sampled values by adding the input signal that was delayed and weighted by the first complex multiplication operation.

The complete filter, composed of the real and imaginary outputs, has the following amplitude frequency response:

$$A(f) = N \cdot \frac{si\left(\frac{N}{2}\left(\varphi - \frac{2 \cdot \pi \cdot f}{f_A}\right)\right)}{si\left(\frac{1}{2}\left(\varphi - \frac{2 \cdot \pi \cdot f}{f_A}\right)\right)},$$

where $f_A$ is the sampling frequency.

The stop-band attenuation of these band-pass filters, which is low initially, can be increased by simultaneously calculating K+1 of such band-pass filters, using the same impulse response duration N, but different values for $\phi$, synchronizing their phase responses with a further complex multiplication operation, and adding up their weighted output signals:

LIST OF REFERENCE NUMBERS

1*a* Test signal, left channel
1*b* Test signal, right channel
IC Reference signal, left channel
1*d* Reference signal, right channel
2 Pre-filtration
3 Filter bank
4 Spectral spreading
5 Calculation of the squared values
6 Time spreading
7 Level and frequency response adjustment
8 Addition of residual noise
9 Time spreading
10 Calculation of output parameters
11 Output parameters $$A(f) = \sum_{k=0}^{K} w_k \cdot A_k(f)$$

where $$\varphi_k = \frac{2 \cdot \pi \cdot f_M}{f_A} + \left(k - \frac{K}{2}\right) \cdot \frac{2\pi}{N}$$

($f_M$: band-pass mid-frequency) and $$w_k = \frac{2\pi}{N} \cdot 2^{-K} \cdot \binom{K}{k}$$

The stop-band attenuation of the resulting filters decreases as the interval between the signal frequency and mid-frequency of the filter is raised to the power of (K+1). The impulse response of the entire filter has the following format:

$$a_K(n) = \sin^K\left(\frac{\pi}{N} n\right) \cdot \cos\left(\frac{2 \cdot \pi \cdot f_M}{f_A} \cdot n\right) \Big| 0 \le n < N$$

for the real portion and $$a_K(n) = \sin^K\left(\frac{\pi}{N} n\right) \cdot \sin\left(\frac{2 \cdot \pi \cdot f_M}{f_A} \cdot n\right) \Big| 0 \le n < N$$

for the imaginary portion. This corresponds to the characteristics described in Equations 2 and 3.

What is claimed is:

1. A measurement method for aurally compensated quality evaluation of audio signals comprising:

comparing an audio test signal to a source reference signal;

breaking down the test signal and the reference signal after a prefiltering step into a frequency range using a filter bank the filter bank having a characteristic and filter output signals;

subsequently time-domain spreading the filter output signals so as to form an aurally compensated representation of the test signal; and comparing the aurally compensated representation of the test signal to an aurally compensated representation of the reference signal, wherein the filter bank is aurally adjusted, and an undamped sinusoidal oscillation having a filter mid-frequency is generated from the test signal by recursive, complex multiplication, the sinusoidal oscillation being discontinued by subtracting the test signal delayed by an amount of time equal to a reciprocal value of a filter bandwidth and multiplied by a phase angle corresponding to the delay.

2. The method as recited in claim 1 further comprising producing an attenuation characteristic by a convolution within the frequency range, the attenuation characteristic corresponding to a Fourier transform of a $\cos^n$ (n−1)-wave time window.

3. The method as recited in claim 2 wherein the attenuation characteristic at a greater distance from a filter mid-frequency at a transition between a pass band and stop band is determined by a further convolution within the frequency range.

4. A measurement method for aurally compensated quality evaluation of audio signals comprising:

generating an undamped sinusoidal oscillation having a filter mid-frequency from each of a plurality of incoming test signals by recursive, complex multiplication;

discontinuing the sinusoidal oscillation belonging to each incoming test signal by subtracting the input test signal delayed by an amount of time equal to a reciprocal value of a filter bandwidth and multiplied by a phase angle corresponding to the delay;

producing an attenuation characteristic by convolution within the frequency range, the attenuation characteristic corresponding to a Fourier transform of a $\cos^n$ (n−1)-wave time window and being produced from n filter outputs having similar bandwidth and mid-frequencies, the attenuation characteristic being offset by a reciprocal value of a length of the time window; and determining the attenuation characteristic at a greater distance from the filter mid-frequency by a further convolution within the frequency range.

5. The method as recited in claim 1 wherein the input test signal includes a first and a second test signal and the reference signal includes a first and second reference signal, the first and second test and reference signals corresponding to input quantities for a left and a right channel, respectively.

6. A measurement method for aurally compensated quality evaluation of audio signals comprising:

prefiltering a test signal and a reference signal, supplying the test and reference signal to a filter bank, and frequency-domain spreading the test signal and the reference signal;

calculating squared values of the test and reference signals and then time-domain spreading the test and reference signals;

level and frequency response adjusting the test and reference signals;

adding residual noise and then performing another time-domain spreading step; and calculating output parameters.

7. The method as recited in claim 6 wherein the prefiltering step includes filtering using transmission functions of the outer and middle ear, the test and reference signals being converted to time-tonality representations by the filter bank, the filter bank being an aurally adjusted filter bank; and further comprising calculating squared values of the filter output signals, and convoluting the filter output signals using a spreading function.

8. The method as recited in claim 7 wherein the convolution takes place before the calculating squared values step.

9. The method as recited in claim 7 wherein the convolution takes place after the calculating squared values step.

10. The method as recited in claim 6 wherein level differences between the test and reference signals as well as linear distortions of the reference signal are compensated for and evaluated separately.

11. The method as recited in claim 6 wherein part of the time-domain spreading operation takes place directly after squared values of the filter output signals are calculated.

12. The method as recited in claim 6 wherein the filter bank is an aurally adjusted filter bank for producing a signal dependency of the filter characteristic by convoluting the filter output signals prior to a calculation of squared valued of the filter output signals using a level-dependent spreading function.

13. The method as recited in claim 6 wherein signal components already existing in the reference signal which vary only in terms of a frequency distribution are separated from additive disturbances or disturbances produced by non-linearities.

14. The method as recited in claim 6 wherein the filter bank includes a randomly selected number of filter pairs for test and reference signals.

15. The method as recited in claim 6 wherein values of the output signals of the filter bank are frequency-domain spread, a level being calculated for each filter output from a squared value, the spreading being carried out independently for real portion filters representing a real portion of the signals and imaginary portion filters representing an imaginary portion of the signals.

16. The method as recited in claim 6 wherein the filter output signals are time-domain spread in a first and a second stage, with the signals being determined via a cosine$^2$-wave time window during the first stage and post-masking being modeled during the second stage.

17. The method as recited in claim 16 wherein the cosine$^2$-wave time windows are between 1 and 16 ms long.

18. The method as recited in claim 16 wherein to adjust the level the squared values are smoothed over time at the filter outputs by first-order low-pass filters, the time constants for the low-pass filters being selected as a function of a mid-frequency of the filter, and further comprising calculating a correction factor from an orthogonality relation between spectral envelopes of the time-smoothed filter outputs of the test and reference signals.

19. The method as recited in claim 18 wherein the test signal is multiplied by the correction factor if the correction factor is less than 1, and the reference signal is divided by the correction factor if the correction factor is greater than 1.

20. The method as recited in claim 16 wherein the correction factors are calculated for each filter channel from the orthogonality relation between the time envelopes of the filter outputs of the test and reference signals.

21. The method as recited in claim 6 wherein a modulation difference suitable for estimating certain audible disturbances is determined for each filter channel.

22. The method as recited in claim 6 wherein a restricted disturbance loudness is determined from input values for the test signal.

23. The method as recited in claim 6 wherein the input test signal is delayed by N sampled values and, after being multiplied by a complex-number factor, is subtracted from the original input test signal so as to form a first result, the first result being added to an output signal delayed by one sampled value to form a second result, the second result, multiplied by a further complex-number factor, yielding a new output signal.

* * * * *